United States Patent [19]

Skaugen

[11] Patent Number: 4,874,470

[45] Date of Patent: Oct. 17, 1989

[54] PAPERMAKING PRESS SECTION AND TRANSFER ARRANGEMENT TO DRYER SECTION

[75] Inventor: Borgeir Skaugen, Beloit, Wis.

[73] Assignee: Beloit Corporation, Beloit, Wis.

[21] Appl. No.: 253,283

[22] Filed: Oct. 4, 1988

[51] Int. Cl.[4] ..... B21F 3/04

[52] U.S. Cl. ..... 162/360.1; 34/117; 162/193; 162/286; 162/306; 162/359

[58] Field of Search ..... 162/305, 306, 360.1, 162/359, 205, 255, 193, 283, 286; 34/116, 117, 120, 123

[56] References Cited

U.S. PATENT DOCUMENTS

| | | | |
|---|---|---|---|
| 3,096,233 | 7/1963 | Rappaport et al. | 162/255 |
| 4,075,056 | 2/1978 | Ely et al. | 162/360.1 |
| 4,086,131 | 4/1978 | Rempel et al. | 162/360.1 |
| 4,257,844 | 3/1981 | Schmitt et al. | 162/360.1 |
| 4,285,766 | 8/1981 | Kankaanpaa | 162/360.1 |
| 4,483,745 | 11/1984 | Wicks et al. | 162/360.1 |
| 4,608,125 | 8/1986 | Autio | 162/360.1 |
| 4,648,942 | 3/1987 | Wanke et al. | 162/359 |

*Primary Examiner*—Kim Hastings

*Attorney, Agent, or Firm*—Dirk J. Veneman; Raymond W. Campbell; David J. Archer

[57] ABSTRACT

A press apparatus is disclosed for pressing water from a web which extends from a forming section to the press apparatus and subsequently from the press apparatus to a drying section. The apparatus includes a pick-up roll which is disposed closely adjacent to the forming section for picking up the formed web from the forming section. A downstream roll couple defines therebetween a first nip for pressing a first portion of water from the formed web. A transfer felt cooperates with the pick-up roll and the first roll couple for transferring the web from the pick-up roll to the first nip. A press roll is disposed downstream relative to the first nip and a first backing roll cooperates with the press roll for defining therebetween a second nip. A second backing roll is disposed downstream relative to the second nip with the second backing roll cooperating with the press roll for defining therebetween a third nip. A guide felt is disposed downstream relative to the third nip for guiding the web away from the press roll subsequent to the passage of the web through the third nip. A further press roll is disposed downstream relative to the third nip with the guide felt guiding the web from the third nip to the further press roll. A further backing roll cooperates with the further press roll for defining therebetween a fourth nip and a lead-in felt is disposed closely adjacent to the further press roll and downstream relative to the fourth nip for leading the web from the further press roll to the drying section.

15 Claims, 2 Drawing Sheets

PAPERMAKING PRESS SECTION AND TRANSFER ARRANGEMENT TO DRYER SECTION

BACKGROUND OF THE INVENTION

1. Field of the Invention

The present invention relates to a press apparatus for pressing water from a web.

More particularly, the present invention relates to a press apparatus having a fourth press and a lead-in felt for leading the web from the fourth press to the drying section.

2. Information Disclosure Statement

Many press section configurations have been proposed for progressively removing water from a formed web.

Usually, it is desirable to remove as much water as possible from the formed web during passage of the web through the press section because it is more economical to press the water from the web than to drive such water out of the web by the application of heat in a subsequent drying section.

The present invention relates to a configuration which includes a fourth press nip which is disposed downstream relative to a first nip defined between a roll couple and a subsequent second and third nip defined between a press roll and a first and second backing roll respectively. The first, second and third nip constitute a tri-nip or a tri-vent pressing arrangement. However, the present invention envisages a guide felt for guiding the web from the third nip through a fourth nip defined between a further press roll and a further backing roll.

The web emerging from the fourth press nip is guided by a lead-in felt towards a vacuum transfer roll of the dryer section so that the web can be automatically threaded into the dryer section.

In operation of the press apparatus according to the present invention, the web is doctored from the press roll subsequent to passage of the web through the third nip. The doctored web is received by a broke pit disposed beneath the press roll. A threading tail is cut from the web and guided by the guide felt through the fourth nip and the threading tail is subsequently widened to a full-width sheet.

By application of suction through a lead-in suction roll of a lead-in means or by the use of a grooved, drilled or solid covered roll, the web emerging from the fourth nip is led by a lead-in felt towards a further broke pit. The threading tail is disposed between the further press roll and the lead-in roll such that the threading tail is drawn towards a vacuum transfer roll disposed in abutting relationship with the lead-in felt. Consequently, the tail is guided around the vacuum transfer roll and is supported by the dryer felt and is guided towards the dryer section.

By the aforementioned arrangement, the manual handling at high speed required by the prior art arrangements for threading the machine is eliminated and furthermore, broke removal is permitted at two locations. Broke removal is in a downward direction thus eliminating the need for the prior art relatively complex horizontal conveyor arrangements which would be difficult if not impossible to operate efficiently at high machine speeds and production rates.

U.S. Pat. No. 4,086,131 to Rempel discloses a press apparatus having four nips but does not permit downward removal of broke prior to the second nip.

Therefore, it is a primary object of the present invention to provide a press apparatus that overcomes the aforementioned inadequacies of the prior art arrangements and that provides a considerable contribution to the art of pressing water from a paper web.

Other objects and advantages of the present invention will be apparent to those skilled in the art by a consideration of the detailed description contained hereinafter taken in conjunction with the annexed drawings and as defined by the appended claims.

SUMMARY OF THE INVENTION

The present invention relates to a press apparatus and method for pressing water from a web which extends from a forming section to the press apparatus and subsequently from the press apparatus to a drying section. The apparatus includes pick-up means disposed closely adjacent to the forming section for picking up the formed web from the forming section. A roll couple is disposed downstream relative to the pick-up means with the roll couple defining therebetween a first nip for pressing a first portion of water from the formed web. A transfer means cooperates with the pick-up means and the roll couple for transferring the web from the pick-up means to the first nip. A press roll is disposed downstream relative to the first nip and a first backing roll cooperates with the press roll for defining therebetween a second nip for pressing a second portion of water from the web. The transfer means cooperates with the first backing roll for transferring the web from the first to the second nip. A second backing roll is disposed downstream relative to the second nip with the second backing roll cooperating with the press roll for defining therebetween a third nip for pressing a third portion of water from the web. A guide means is disposed downstream relative to the third nip for guiding the web away from the press roll subsequent to the passage of the web through the third nip. A further press roll is disposed downstream relative to the third nip, the guiding means guiding the web from the third nip to the further press roll. A further backing roll cooperates with the further press roll for defining therebetween a fourth nip and a lead-in means is disposed closely adjacent to the further press roll and downstream relative to the fourth nip for leading the web from the further press roll to the drying section.

More particularly, the pick-up means is a suction pick-up roll and the roll couple includes a grooved roll and a felted roll which cooperates with the grooved roll to define therebetween the first nip. The transfer means includes a transfer felt which extends from the pick-up means to and through the first nip for transferring the web from the pick-up means to and through the first nip. The transfer felt also extends through the second nip and the press roll is a granite roll. The first and second backing rolls are self-loading compensated crown rolls.

In one embodiment of the present invention, a doctor cooperates with the press roll for doctoring the web from the press roll after passage of the web through the third nip. A broke pit is disposed beneath the doctor for receiving broke doctored from the press roll. Additionally, means for cutting a threading tail from the web is disposed upstream relative to the third nip for enabling subsequent threading of the web through the fourth nip.

The guide means also includes a guide roll which is disposed closely adjacent to the press roll and downstream relative to the third nip for guiding the web away from the press roll. Additionally, the guide means includes a suction roll disposed closely adjacent to and downstream relative to the guide roll such that the web is guided between the guide roll and the suction roll. A guide felt extends around the suction roll such that the web is supported and guided by the guide felt. A further suction roll is disposed downstream relative to the suction roll with the guide felt extending around the further suction roll.

The further press roll is a granite roll and the further backing roll is a self-loading compensated crown roll.

The guide felt extends around the further backing roll such that the web and the guide felt extend through the fourth nip.

In a preferred embodiment of the present invention, a further doctor cooperates with the further press roll for doctoring the web from the further press roll after passage of the web through the fourth nip. A further broke pit is disposed beneath the further doctor for receiving broke doctored from the further press roll. Additionally, further means are provided for guiding a threading tail from the web for subsequent threading of the web through the dryer section.

In one embodiment of the present invention, the lead-in means includes a lead-in roll disposed closely adjacent to the further press roll for drawing the web away from the further press roll. A lead-in felt extends around the lead-in roll such that the web is supported by the lead-in felt from the lead-in roll towards the dryer section.

A vacuum transfer roll is disposed in abutting relationship with the lead-in felt such that the web is disposed between the lead-in felt and the transfer roll. A dryer felt extends around the vacuum transfer roll such that the web is drawn by the vacuum transfer roll away from the lead-in felt so that the web is guided by the dryer felt through the dryer section.

In a preferred embodiment of the present invention, the dryer section is a TOTAL BELRUN section as disclosed in U.S. Ser. No. 014,569 filed Feb. 13, 1987. All of the subject matter of Ser. No. 014,569 is incorporated herein by reference. TOTAL BELRUN is a common law mark of Beloit Corporation.

In alternative embodiment of the present invention, a smooth roll is disposed downstream relative to the fourth nip with the smooth roll cooperating with the third press roll for defining therebetween a smoothing nip. The smooth roll leads the web towards a dryer felt of the dryer section.

In yet another embodiment of the present invention, a vacuum transfer roll of the dryer section is a pivoting roll which pivots from a first location which is disposed away from the lead-in felt such that the web supported by the lead-in felt is guided towards a further broke pit disposed beneath the further press roll. The pivoting roll pivots to a second location in which the pivoting roll is disposed in abutting relationship with the lead-in felt for transferring the web from the lead-in felt to the dryer felt.

Although the present invention is described with a certain degree of particularity in the detailed description contained hereinafter, it will be apparent to those skilled in the art that many modifications and variations of the present invention are possible. Such variations and modifications, however, fall within the spirit and scope of the present invention as defined by the appended claims.

BRIEF DESCRIPTION OF THE DRAWINGS

Similar reference characters refer to similar parts throughout the various embodiments of the present invention.

DETAILED DESCRIPTION OF THE DRAWINGS

Figure 1:
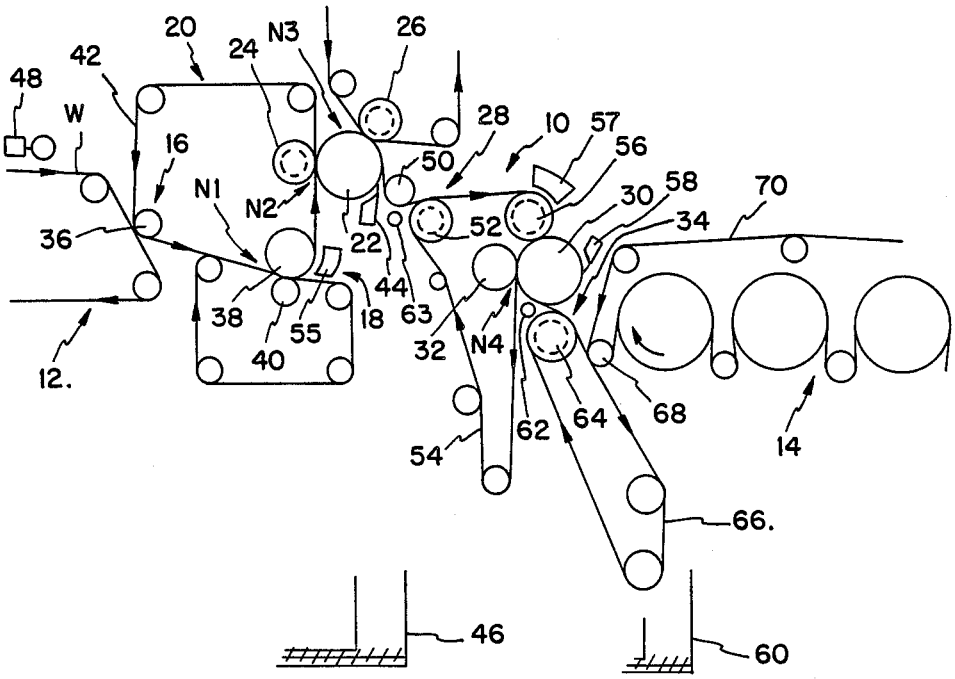
FIG. 1 is an elevational view of the press apparatus according to the present invention showing the fourth press nip.

FIG. 1 is an elevational view of a press apparatus generally designated 10 according to the present invention for pressing water from a web W which extends from a forming section generally designated 12 to the press apparatus 10 and subsequently from the press apparatus 10 to a drying section generally designated 14. The apparatus 10 according to the present invention includes a pick-up means generally designated 16 disposed closely adjacent to the forming section 12 for picking up the formed web W from the forming section 12. A roll couple generally designated 18 is disposed downstream relative to the pick-up means 16 with the roll couple 18 defining therebetween a first nip N1 for pressing a first portion of water from the formed web W.

Transfer means generally designated 20 cooperate with the pick-up means 16 and the roll couple 18 for transferring the web W from the pick-up means 16 to the first nip N1.

A press roll 22 is disposed downstream relative to the first nip N1 and a first backing roll 24 cooperates with the press roll 22 for defining therebetween a second nip N2 for pressing a second portion of water from the web W. The transfer means 20 cooperates with the first backing roll 24 for transferring the web W from the first nip N1 to the second nip N2.

A second backing roll 26 is disposed downstream relative to the second nip N2. The second backing roll 26 cooperates with the press roll 22 for defining therebetween a third nip N3 for pressing a third portion of water from the web W.

Guide means generally designated 28 are disposed downstream relative to the third nip N3 for guiding the web W away from the press roll 22 subsequent to the passage of the web W through the third nip N3.

A further press roll 30 is disposed downstream relative to the third nip N3 with the guide means 28 guiding the web W from the third nip N3 to the further press roll 30.

A further backing roll 32 cooperates with the further press roll 30 for defining therebetween a fourth nip N4 and a lead-in means generally designated 34 is disposed closely adjacent to the further press roll 30 and downstream relative to the fourth nip N4 for leading the web W from the further press roll 30 to the drying section 14.

More specifically, the press apparatus 10 includes the pick-up means 16 which is a suction pick-up roll 36.

Additionally, the roll couple 18 includes a grooved roll 38 and a felted roll 40 which cooperates with the grooved roll 38 to define therebetween the first nip N1.

The transfer means 20 includes a transfer felt 42 which extends from the pick-up means 16 to and through the first nip N1 for transferring the web W from the pick-up means 16 to and through the first nip N1. The transfer felt 42 extends through the second nip N2 and the press roll 22 is a granite roll. Alternatively, the roll 22 may be a covered roll or the like.

The first backing roll 24 and the second backing roll 26 are both self-loading compensated crown rolls. Alternatively, the backing rolls 24, 26 may be plain or grooved rolls or the like.

The press apparatus 10 also includes a doctor 44 which cooperates with the press roll 22 for doctoring the web W from the press roll 22 after passage of the web W through the third nip N3.

A broke pit 46 is disposed beneath the doctor 44 for receiving broke doctored from the press roll 22.

Means generally designated 48 are provided for cutting a threading tail from the web W for subsequent threading of the web W through the fourth nip N4.

The guide means 28 also includes a guide roll 50 which is disposed closely adjacent to the press roll 22 and downstream relative to the third nip N3 for guiding the web W away from the press roll 22.

The guide means 28 also includes a suction roll 52 which is disposed closely adjacent to and downstream relative to the guide roll 50 such that the web W is guided between guide roll 50 and the suction roll 52.

The guide means 28 includes a guide felt 54 which extends around the suction roll 52 such that the web W is supported and guided by the guide felt 54.

Additionally, the guide means 28 includes a further suction roll 56 disposed downstream relative to the suction roll 52 with the guide felt 54 extending around the further suction roll 56.

Steam boxes 55 and 57 are disposed adjacent to the rolls 38 and 56 respectively. The box 57 in connection with suction roll 56 permits heating of the web W.

The further press roll 30 is a granite roll and the further backing roll 32 is a self-loading compensated crown roll. Alternatively, the roll 30 may be a release covered press roll and the roll 32 may be a covered press roll or the like.

The guide felt 54 extends around the further backing roll 32 such that web W and the guide felt 54 extend through the fourth nip N4.

A further doctor 58 cooperates with the further press roll 30 for doctoring the web W from the further press roll 30 after passage of the web W through the fourth nip N4.

A further broke pit 60 is disposed beneath the further doctor 58 for receiving broke doctored from the further press roll 30.

Further means generally designated 62 are provided for guiding a threading tail from the web W for subsequent threading through the dryer section 14.

Additionally, guiding means such as an air nozzle 63 are provided for threading a tail towards the fourth nip.

The lead-in means 34 includes a lead-in suction roll 64 which is disposed closely adjacent to the further press roll 30 for drawing the web W away from the further press roll 30.

A lead-in felt 66 extends around the lead-in suction roll 64 such that the web W is supported by the lead-in felt 66 from the lead-in suction roll 64 towards the dryer section 14. Alternatively, the roll 64 may be a grooved, drilled or solid covered roll.

The dryer section 14 includes a vacuum transfer roll 68 which is disposed in abutting relationship with the lead-in felt 66 such that the web W is disposed between the lead-in felt 66 and the transfer roll 68.

A dryer felt 70 extends around the vacuum transer roll 68 such that the web W is drawn by the vacuum transfer roll 68 away from the lead-in felt 66 and so that the web W is guided by the dryer felt 70 through the dryer section 14.

As shown in FIG. 1, the dryer section 14 is a TOTAL BELRUN section. However, the present invention is applicable to a variety of dryer configurations.

Figure 2:
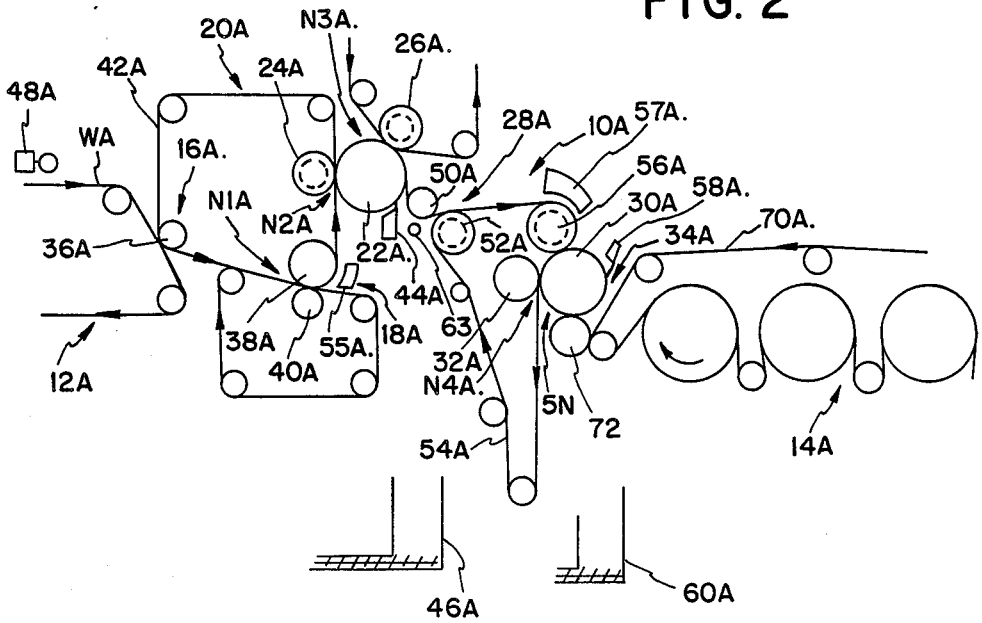
FIG. 2 is an elevational view of an alternative embodiment to the present invention showing a smooth roll which cooperates with the further press roll for defining therebetween a smoothing nip.

FIG. 2 is an elevational view of a further embodiment of the present invention in which similar parts are referred to by similar numerals but with the suffix "A" added thereto.

More particularly, in the alternative embodiment as shown in FIG. 2, the lead-in means 34A includes a smooth roll 72 which is disposed downstream relative to the fourth nip N4A. The smooth roll 72 cooperates with a further press roll 30A for defining therebetween a smoothing nip SN. The smooth roll 72 leads the web WA towards a dryer felt 70A of the dryer section 14A.

Figure 3:
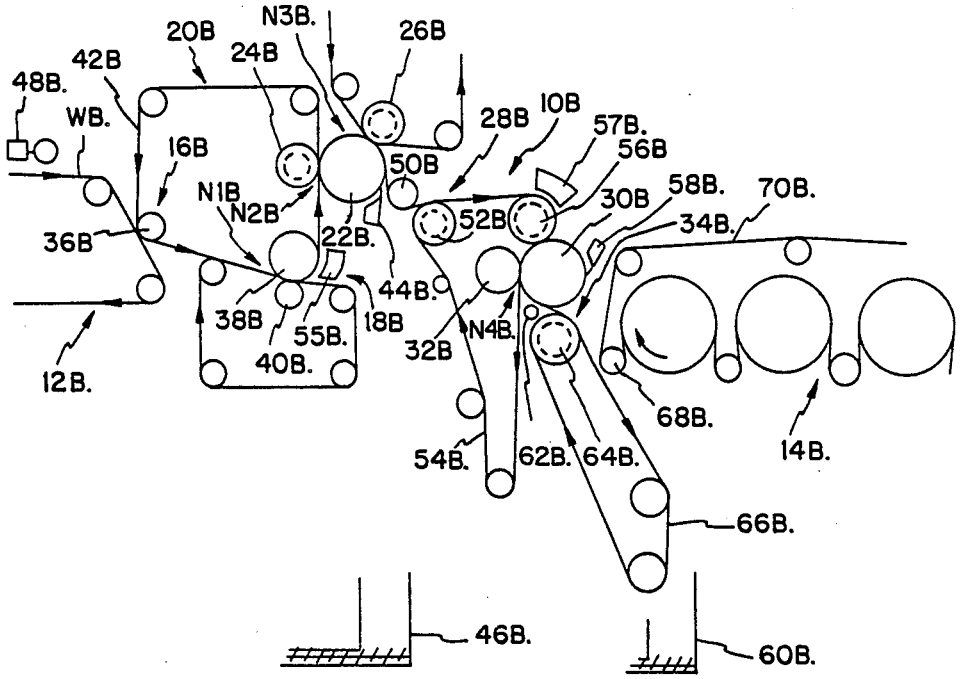
FIG. 3 is an elevational view of a further embodiment of the present invention in which the vacuum transfer roll is a pivoting roll in a first location for assisting transfer of the web from the press apparatus to the dryer section.
Figure 4:
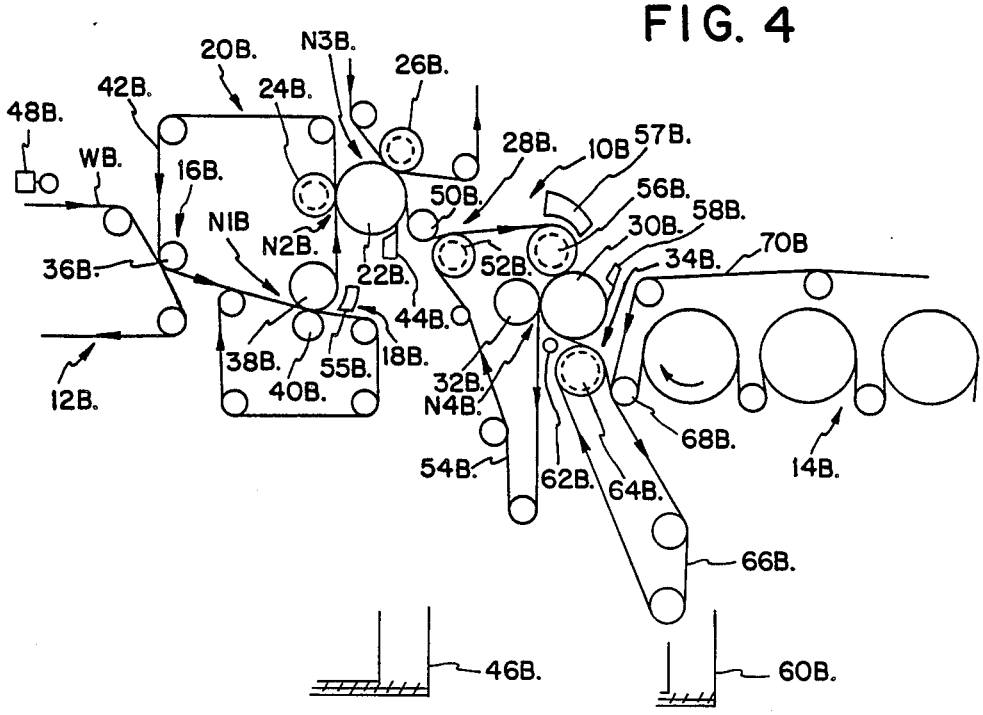
FIG. 4 is an elevational view of the embodiment shown in FIG. 3 with the transfer roll in a second location abutting against the lead-in felt.

FIGS. 3 and 4 are elevational views of a further embodiment to the present invention and show a vacuum transfer roll 68B which is a pivoting roll. The pivoting roll 68B pivots from a first location as shown in FIG. 3 away from the lead-in felt 66B such that the web WB supported by the lead-in felt 66B is guided towards a further broke pit 60B disposed beneath the further press roll 30B. The transfer roll 68B pivots to a second location as shown in FIG. 4 in which the pivoting roll 68B is disposed in abutting relationship with the lead-in felt 66B for transferring the web WB from the lead-in felt 66B to the dryer felt 70B.

In operation of the apparatus according to the present invention, the web W is guided by the transfer felt 42 through the first nip N1 and then through the second and third nips N2 and N3 where the web is doctored from the press roll 22 by doctor 44. The doctored web is received by the broke pit 46 and a tail of the web is cut by means 48 and is guided by the guide means 63 towards the fourth nip N4. The tail is widened out to provide a full-width sheet which then subsequently extends through the fourth nip N4. A full sheet web is then guided by the lead-in felt around the lead-in suction roll 64 to the dryer felt 70. A further threading means 62 guides the tail if such threading is necessary and the tail is automatically drawn towards the vacuum transfer roll 68 and onto the dryer felt 70.

After the tail has reached the end of the apparatus and proper draws have been established, the tail is widened to the full width of the web. More specifically, the tail is doctored off by the doctor 34 and falls onto the lead-in felt and is then picked up by the vacuum transfer roll thus transferring the tail and then the full-width sheet to the dryer felt after the required draw has been set.

If threading ropes are deemed necessary, an air wand is required in order to bring the tail into the ropes.

In the embodiment which incorporates a pivoting vacuum transfer roll 68B, the pivoting roll 68B permits easy disposal in a downward direction of broke doctored from the further press roll 30B.

The present arrangement provides a press apparatus which is operable at extremely high speeds such as 4500 feet per minute and which provides automatic threading thereof thereby eliminating the need for handling the sheet at high speed. Additionally, the present invention provides means for easily removing broke in a downward direction after passage of the web through the third and fourth nips respectively.

What is claimed is:

1. A press apparatus for pressing water from a web which extends from a forming section to said press apparatus and subsequently from said press apparatus to a drying section, said apparatus comprising:

pick-up means disposed closely adjacent to the forming section for picking-up the formed web from the forming section;

a roll couple disposed downstream relative to said pick-up means, said roll couple defining therebetween a first nip for pressing a first portion of water form the formed web;

transfer means cooperating with said pick-up means and said roll couple for transferring the web from said pick-up means to said first nip;

a press roll disposed downstream relative to said roll couple;

a first backing roll disposed downstream relative to said roll couple, said first backing roll cooperating with said press roll for defining therebetween a second nip for pressing a second portion of water form the web, said transfer means cooperating with said first backing roll for transferring the web from said first to said second nip;

a second backing roll disposed downstream relative to said second nip, said second backing roll cooperating with said press roll for defining therebetween a third nip for pressing a third portion of water form the web;

a doctor cooperating with said press roll for doctoring the web from said press roll after passage of the web through said third nip;

a broke pit disposed beneath said doctor for receiving broke doctored from said press roll;

guide means disposed downstream relative to said third nip for guiding the web away from said press roll subsequent to the passage of the web through said third nip;

a further press roll disposed downstream relative to said third nip, said guide means guiding the web from said third nip to said further press roll;

a further backing roll cooperating with said further press roll for defining therebetween a fourth nip;

a further doctor cooperating with said further press roll for doctoring the web from said further press roll after passage of the web through said fourth nip;

a further broke pit disposed beneath said further doctor for receiving broke doctored from said further press roll; and lead-in means disposed closely adjacent to and below said further press roll and downstream relative to said fourth nip and upstream relative to said further doctor blade for leading the web from said further press roll to the drying section said lead-in means further includes a lead-in roll disposed closely adjacent to said further press roll for drawing the web away from said further press roll, a lead-in felt extending around said lead-in roll such that the web is supported by said lead-in felt and said lead-in roll towards the dryer section; and the dryer section further includes a vacuum transfer roll disposed above and in abutting relationship with said lead-in felt such that the web is disposed between said lead-in felt and said transfer roll;

a dryer felt extending around said vacuum transfer roll such that the web is drawn by said vacuum transfer roll away from said lead-in felt and so that the web is guided by said dryer felt through the dryer section.

2. A press apparatus as set forth in claim 1 wherein said pick-up means is a suction pick-up roll.

3. A press apparatus as set forth in claim 1 wherein said roll couple further includes:

a grooved roll;

a felted roll cooperating with said grooved roll to define therebetween said first nip.

4. A press apparatus as set forth in claim 1 wherein said transfer means includes:

a transfer felt which extends from said pick-up means to and through said first nip for transferring the web from said pick-up means to and through said first nip.

5. A press apparatus as set forth in claim 4 wherein said transfer felt extends through said second nip.

6. A press apparatus as set forth in claim 1 wherein said press roll is a granite roll.

7. A press apparatus as set forth in claim 1 wherein said first backing roll is a self-loading compensated crown roll.

8. A press apparatus as set forth in claim 1 wherein said second backing roll is a self-loading compensated crown roll.

9. A press apparatus as set forth in claim 1 further including:

means for cutting a threading tail from the web for subsequent threading through said fourth nip;

threading means disposed upstream relative to said fourth nip for threading said tail through said fourth nip.

10. A press apparatus as set forth in claim 1 wherein said guide means further includes:

a guide roll disposed closely adjacent to said press roll and downstream relative to said third nip for guiding the web away from said press roll;

a suction roll disposed closely adjacent to and downstream relative to said guide roll such that the web is guided between said guide roll and said suction roll;

a guide felt extending around said suction roll such that the web is supported and guided by said guide felt;

a further suction roll disposed downstream relative to said suction roll, said guide felt extending around said further suction roll.

11. A press apparatus as set forth in claim 1 wherein said further press roll is a granite roll.

12. A press apparatus as set forth in claim 1 wherein said further backing roll is a self-loading compensated crown roll.

13. A press apparatus as set forth in claim 10 wherein said guide felt extends around said further backing roll such that the web and said guide felt extend through said fourth nip.

14. A press apparatus as set forth in claim 9 further including:

a further means for guiding a threading tail from the web for subsequent threading through the dryer section.

15. A press apparatus as set forth in claim 1 further including:

means for pivoting said vacuum transfer roll such that said vacuum transfer roll pivots from a first location away from said lead-in felt such that the web supported by said lead-in felt is guided towards said further broke pit disposed beneath said further press roll to a second location in which said pivoting roll is disposed in abutting relationship with said lead-in felt for transferring the web from said lead-in felt to said dryer felt.

* * * * *